US008781364B2

(12) United States Patent
Fukuda et al.

(10) Patent No.: US 8,781,364 B2
(45) Date of Patent: Jul. 15, 2014

(54) REPLACEMENT FIXING BELT AND METHOD OF REPLACING A FIXING BELT

(75) Inventors: Takeshi Fukuda, Nagareyama (JP); Kazuaki Aoki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/599,144

(22) Filed: Aug. 30, 2012

(65) Prior Publication Data

US 2013/0084102 A1 Apr. 4, 2013

(30) Foreign Application Priority Data

Sep. 30, 2011 (JP) ..... 2011-216977

(51) Int. Cl.
*G03G 15/20* (2006.01)

(52) U.S. Cl.
USPC ..... 399/122; 399/329; 399/333

(58) Field of Classification Search
CPC ..... G03G 15/20; G03G 15/2053; G03G 2215/1685; G03G 2215/2035; G03G 2215/2048; G03G 2215/2096; G03G 2215/2093; G03G 21/1685
See application file for complete search history.

(56) References Cited

U.S. PATENT DOCUMENTS

| | | | | |
|---|---|---|---|---|
| 5,300,999 | A * | 4/1994 | Koh et al. | 399/329 |
| 7,539,449 | B2 | 5/2009 | Aoki | |
| 2009/0285609 | A1 * | 11/2009 | Hayashi | 399/328 |
| 2010/0296828 | A1 | 11/2010 | Hara et al. | |

FOREIGN PATENT DOCUMENTS

| | | | | |
|---|---|---|---|---|
| JP | 2005-317519 A | | 11/2005 | |
| JP | 2007-163794 A | | 6/2007 | |
| JP | 2007-163794 A | * | 6/2007 | G03G 15/20 |
| JP | 2007-293012 A | | 11/2007 | |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A replacement fixing belt to be used in a fixing apparatus, the replacement fixing belt including: an endless base layer; a toner releasing layer provided on a surface of the replacement fixing belt; and a lubrication film formed on an inner surface of the endless base layer by applying to the inner surface a liquid in which a fluorinated oil and fluorinated solid lubricant particles are dispersed in a volatile solvent.

17 Claims, 6 Drawing Sheets

REPLACEMENT FIXING BELT AND METHOD OF REPLACING A FIXING BELT

BACKGROUND OF THE INVENTION

1. Field of the Invention

The present invention relates to a replacement fixing belt to be used in a fixing apparatus, and a method of replacing a fixing belt. The fixing apparatus can be used in an image forming apparatus such as a copier, a printer, a facsimile, and a multifunction peripheral having a plurality of functions of those apparatus.

2. Description of the Related Art

Conventionally, in the image forming apparatus such as a copier, there has been employed a fixing apparatus configured to fix, by using a fixing belt, a toner image that has been formed on a recording material. In recent years, there has been a demand to quickly start printing, specifically, to complete image formation onto a first recording sheet in a short period of time after reception of a printing instruction (quick start). Accordingly, attempts have been made to reduce the heat capacity of the fixing belt.

In the apparatus disclosed in Japanese Patent Application Laid-Open No. 2005-317519 and Japanese Patent Application Laid-Open No. 2007-293012, which employ such a fixing belt, heat-resistant grease is applied to an outer surface of a sliding member (heater) in sliding relation to an inner surface of the fixing belt in order to improve the slidability of the sliding member with respect to the inner surface of the fixing belt.

Conventionally, there has been employed a configuration in which the fixing apparatus is replaced as a whole when a fixing belt outlives its usefulness. However, it is desired that the fixing belt be replaced alone.

In order to meet such a demand, it is necessary to solve problems with how to replenish the heat-resistant grease to be interposed between the fixing belt and the sliding member.

For example, when an operator is forced to carry out an operation of applying the heat-resistant grease to the outer surface of the sliding member at every replacement of the fixing belt, such an applying operation is troublesome to the operator, which is insufficient as a solution to the problems.

SUMMARY OF THE INVENTION

The present invention provides a replacement fixing belt of which replacement is improved.

A replacement fixing belt to be used in a fixing apparatus includes: an endless base layer; a toner releasing layer provided on a surface of the replacement fixing belt; and a lubrication film formed on an inner surface of the endless base layer by applying to the inner surface a liquid in which a fluorinated oil and fluorinated solid lubricant particles are dispersed in a volatile solvent.

The present invention provides a method of replacing a fixing belt of which replacement is improved.

A method of replacing a fixing belt to be used in a fixing apparatus includes: forming a lubrication film by applying a liquid in which a fluorinated oil and fluorinated solid lubricant particles are dispersed in a volatile solvent to an inner surface of a replacement fixing belt including an endless base layer and a toner releasing layer provided on a surface of the replacement fixing belt; pulling out a used fixing belt from the fixing apparatus substantially along a width direction of the used fixing belt; and inserting the replacement fixing belt into the fixing apparatus substantially along a width direction of the replacement fixing belt.

Further features of the present invention will become apparent from the following description of exemplary embodiments with reference to the attached drawings.

DESCRIPTION OF THE EMBODIMENTS

In the following, embodiments of the present invention will be described in detail with reference to the drawings. The present invention can be carried out in other embodiments in which a structure of each of the embodiments is partially or entirely replaced with an alternative structure as long as a lubrication film is formed in advance on an inner surface of a replacement fixing belt to be used in a fixing apparatus.

Thus, a rotary member which is in abutment with the fixing belt to form a heating nip is not limited to a roller member and may include a belt member. A method of heating the heating nip is not limited to resistance heating, and may include radiant heating, electromagnetic induction heating, gas combustion, and heat-pipe heating.

The image forming apparatus may be applicable irrespective of monochrome/full-color, sheet-fed type/recording material conveying type/intermediate transfer type, toner image forming methods, and transfer methods. Although only a principal part relating to the formation/transfer of a toner image is described in the embodiments of the present invention, the present invention is applicable to an image forming apparatus for various uses such as a printer, various printing machines, a copier, a facsimile, and a multifunction peripheral with the addition of necessary device, equipment, and housing structure.

Image Forming Apparatus

Figure 1:
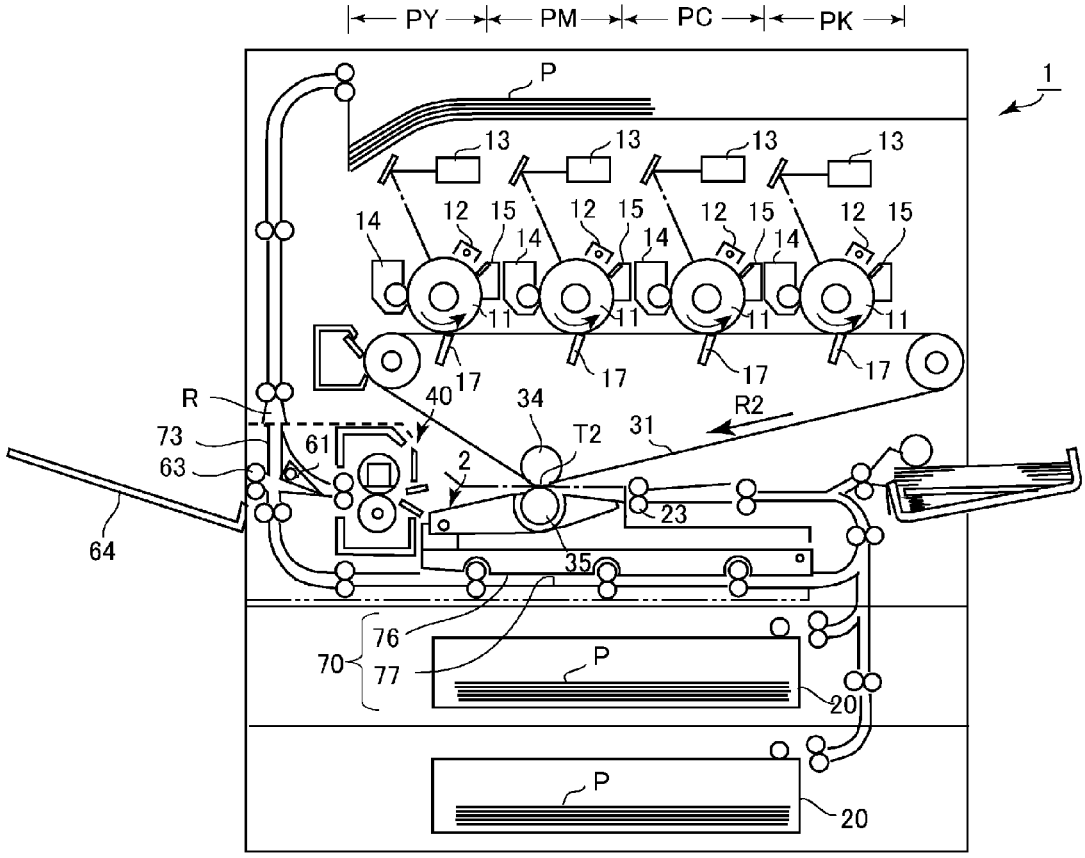
FIG. 1 is an explanatory view of a structure of an image forming apparatus.

FIG. 1 is an explanatory view of a structure of an image forming apparatus 1. As illustrated in FIG. 1, the image forming apparatus 1 is a full color printer using an intermediate transfer method of a tandem type in which a yellow image forming portion PY, a magenta image forming portion PM, a cyan image forming portion PC, and a black image forming portion PK are arranged along an intermediate transfer belt 31.

In the image forming portion PY, a yellow toner image is formed on a photosensitive drum 11(Y) and transferred to the intermediate transfer belt 31. In the image forming portion PM, a magenta toner image is formed on a photosensitive drum 11(M) and transferred to the intermediate transfer belt 31. In the image forming portion PC, a cyan toner image is formed on a photosensitive drum 11(C). In the image forming portion PK, a black toner image is formed on a photosensitive drum 11(K). Then, the cyan toner image and black toner images are sequentially transferred to the intermediate transfer belt 31.

Recording materials P are picked up one by one from recording material cassettes 20, conveyed to a registration roller pair 23, and wait at the registration roller pair 23. Each recording material P is fed by the registration roller pair 23 to a secondary transfer portion T2 at an appropriate timing with respect to the toner images on the intermediate transfer belt 31. In this way, the toner images are secondarily transferred from the intermediate transfer belt 31 to the recording material P. The recording material P, on which the four-color toner images are secondarily transferred, is conveyed to a fixing apparatus 40, and then heated and pressurized by the fixing apparatus 40 so that the toner images are fixed. After that, the recording material P is delivered by a delivery roller pair 63 onto an external tray 64.

Meanwhile, when image formation is performed on both sides of the recording material P, the recording material P is guided upward by a flapper 61 after toner images are fixed on one side of the recording material P by the fixing apparatus. Then, the recording material P is conveyed in a switchback manner in a conveying path 73 so that a front side and a back side of the recording material P are reversed. After that, the recording material P is conveyed through a duplex conveying path 70 to wait at the registration roller pair 23. Then, the toner images are formed also on another side of the recording material P at the secondary transfer portion T2, and fixed by the fixing apparatus 40. After that, the recording material P is delivered onto the external tray 64. Specific examples of the recording material P subjected to toner image formation include a plain sheet, a resin sheet as a substitute for the plain sheet, a coated sheet, a thick sheet, and an overhead projector sheet.

The image forming portions PY, PM, PC, and PK have substantially the same configuration except that their respective developing devices 14 are different in toner color from each other, that is, yellow, magenta, cyan, and black. In the following, only the image forming portion PY using yellow will be described, and the redundant explanation of the other image forming portions PM, PC, and PK will be omitted.

The image forming portion PY includes a photosensitive drum 11, and a corona charger 12, an exposure device 13, a developing device 14, a transfer blade 17, and a drum cleaning device 15 which are disposed around the photosensitive drum 11. The corona charger 12 charges a surface of the photosensitive drum 11 at a uniform potential. The exposure device 13 scans a laser beam on the photosensitive drum 11 to form an electrostatic image on the photosensitive drum 11. The developing device 14 develops the electrostatic image to form a toner image on the photosensitive drum 11. The transfer blade 17 to which a voltage is applied transfers the toner image on the photosensitive drum 11 to the intermediate transfer belt 31.

Fixing Apparatus

Figure 2:
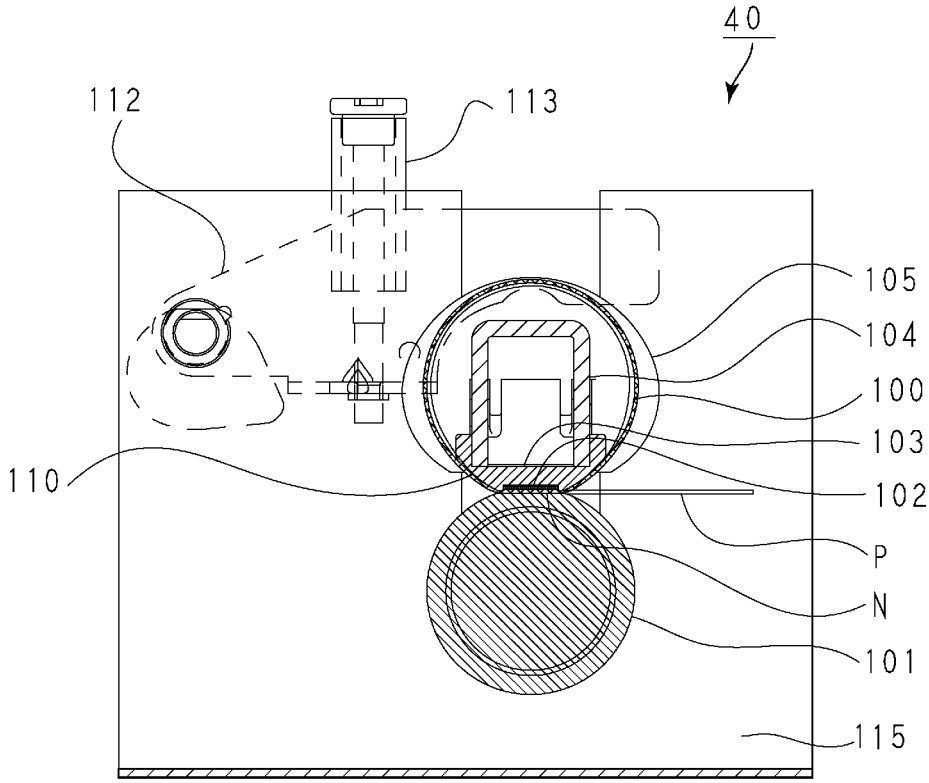
FIG. 2 is an explanatory view of a structure in a cross-section surface perpendicular to a rotation axis direction of a fixing apparatus.
Figure 3:
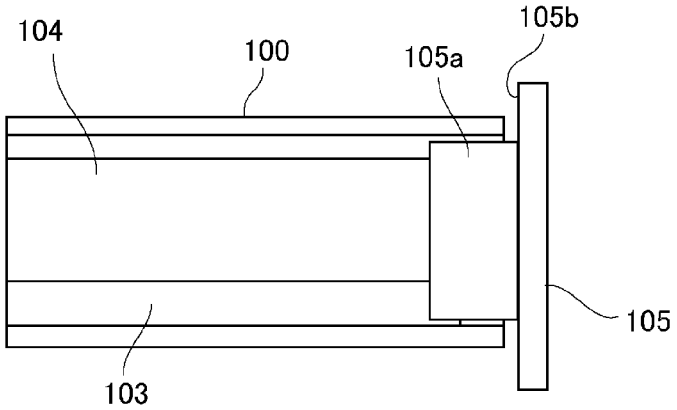
FIG. 3 is an explanatory view of a belt guide.
Figure 4:
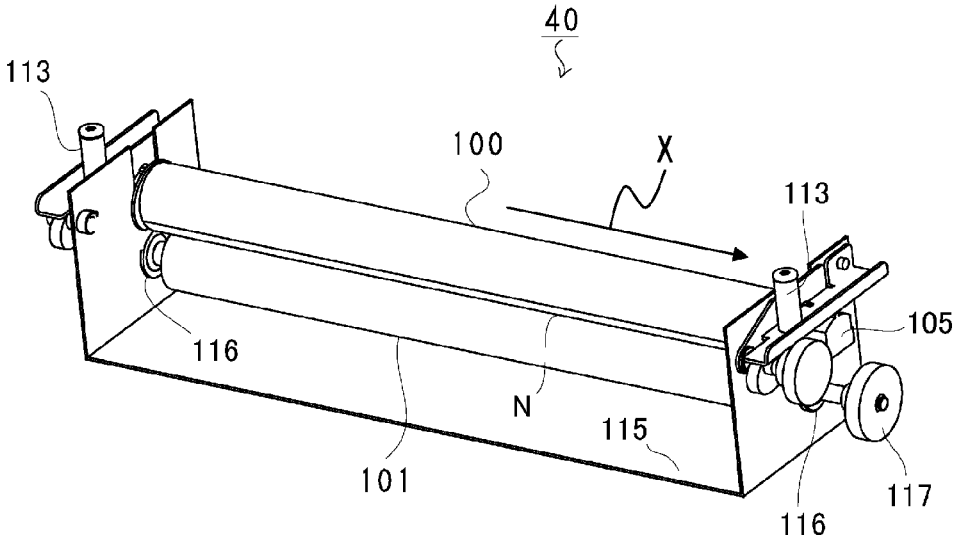
FIG. 4 is a perspective view of the fixing apparatus.
Figure 5:
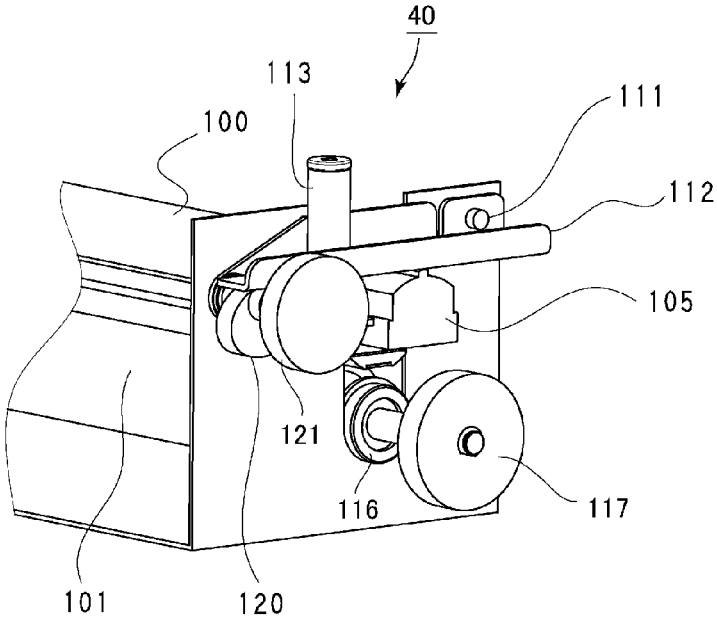
FIG. 5 is an enlarged view of a structure of an end portion of the fixing apparatus.
Figure 6:
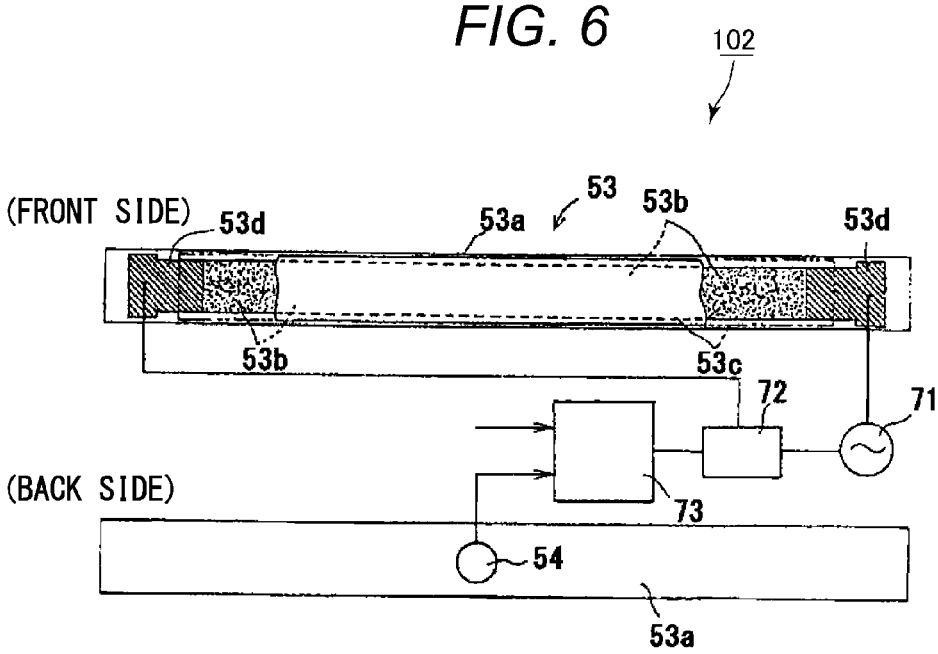
FIG. 6 is an explanatory view of a heating member.

FIG. 2 is an explanatory view of a structure in a cross-section surface perpendicular to a rotation axis direction of the fixing apparatus 40. FIG. 3 is an explanatory view of a belt guide 105. FIG. 4 is a perspective view of the fixing apparatus 40. FIG. 5 is an enlarged view of a structure of an end portion of the fixing apparatus 40. FIG. 6 is an explanatory view of a heating member 102. Note that, a width direction of a fixing belt 100 (the direction indicated by the arrow X in FIG. 4) is a direction parallel to a direction orthogonal to a conveying direction of the recording material in the fixing apparatus 40, and is also a direction parallel to an axial direction of a pressure roller 101.

As illustrated in FIG. 2, the fixing apparatus 40 as an example of an image heating apparatus includes the fixing belt 100 as an example of a belt member and the pressure roller 101 as an example of a rotary member. An inner surface of the fixing belt 100 is supported by a pressure pad 103 as an example of a fixed support member which is substantially non-rotatably fixed to the fixing apparatus 40. The pressure roller 101 is in abutment with an outer surface of the fixing belt 100 to form a heating nip (fixing nip) N configured to heat the recording material P between the pressure roller 101 and the fixing belt 100.

The pressure roller 101 is a roller member having an elastic layer. The pressure pad 103 forms the heating nip N by nipping the fixing belt 100 between the pressure pad 103 and the pressure roller 101. The heating member 102 as an example of a planar resistance heating element is arranged on a surface of the pressure pad 103. The heating member 102 heats the toner images on the recording material through the fixing belt 100. The pressure roller 101 is brought into abutment with the outer surface of the fixing belt 100 of which the inner surface is supported by the pressure pad 103 to pressurize the fixing belt 100 against the pressure pad 103.

In the image forming apparatus 1, the electrostatic image formed on the photosensitive drum 11 is developed into a visible toner image, and the toner image is transferred onto the recording material with an electrostatic force and pressure. Next, the transferred image is fixed to a recording material by heat and pressure of the fixing apparatus 40 so that an image is formed on the recording material. As an example of a fixation method to be employed as that for the fixing apparatus 40, there is a belt fixation method.

The fixing apparatus 40 that employs the belt fixation method conveys the fixing belt 100 while bringing the fixing belt 100 into pressure contact with a heater directly fixed and supported by a holder made of a metal or a resin, and pressurizes a back side of the recording material using the pressure roller 101 while bringing an image surface of the recording material into close contact with the heater through the fixing belt. During the process in which the recording material is conveyed while being nipped between the fixing belt 100 and the pressure roller 101, heat of the heater is applied to the recording material through the fixing belt, and in this state, unfixed toner images borne on a surface of the recording material are fixed onto the surface of the recording material by pressure of the pressure roller 101.

As illustrated in FIG. 2, the fixing belt 100 is a thin and hollow endless belt. The inner surface of the fixing belt 100 is supported by the pressure pad 103 on a side opposite to a side of the pressure roller 101. In a lower surface of the pressure pad 103, a recessed part is formed continuously in a longitudinal direction of the pressure pad 103, and the heating member 102 is arranged to be accommodated in the recessed part. The heating member 102 heats the image surface of the recording material P through the fixing belt 100.

The heating member 102 and the pressure pad 103 rub the inner surface of the fixing belt 100 in a sliding manner. A lubrication film (lubrication coat) 110 is prepared in advance between a sliding surface of the heating member 102 and the pressure pad 103 and the inner surface of the fixing belt 100 in order to reduce a frictional force. A belt frame 104 is extended like a beam through the fixing belt 100 in the rotation axis direction to hold down, from above, the pressure pad 103 to maintain the pressure pad 103 in a linear shape; otherwise the pressure pad 103 will be deformed into an arcuate shape by being pressed from below by the pressure roller 101.

As illustrated in FIG. 3, the belt guide 105 is a guide member for rotation of the belt. The belt guide 105 restricts not only movement in a rotational direction of an inner surface of a belt end portion of the fixing belt 100, but also movement in a thrust direction of the fixing belt 100. The belt guide 105 is arranged at each end portion of the belt frame 104 in the longitudinal direction thereof. Inner belt surface guide portions 105*a* of the belt guide 105 maintain end portions of the fixing belt 100 in a cylindrical state from inner sides of the end portions. A thrust restricting portion 105*b* standing upright in a flange shape from each of the inner belt surface guide portions 105*a* restricts movement of the fixing belt 100 in the rotation axis direction.

As illustrated in FIG. 4, the pressure roller 101 is supported to be freely rotatable by bearings 116 fixed to a fixing frame 115. The belt guides 105 disposed at the end portions of the fixing belt 100 are urged from above toward the pressure roller 101 by compression springs 113. The pair of belt guides 105 thus urged brings the outer surface of the fixing belt 100 into pressure contact with the pressure roller 101 so that the heating nip N for the recording material P is formed. The recording material P passes through the heating nip N, and then is separated from the fixing belt 100 and delivered.

As illustrated in FIG. 5, during operation of the fixing apparatus 40, the pressure roller 101 is driven to be rotated by a fixing drive portion (not shown) through a gear 117. The fixing belt 100 is rotated in association with rotation of the pressure roller 101.

Each of pressure levers 112 is pivotable about a central shaft 111 and has a swing end urged downward by the compression spring 113. Through the belt guides 105, the pressure levers 112 hold downward the fixing belt 100 supported by the belt frame 104 over the entire length of the fixing belt 100 as illustrated in FIG. 2.

The pressure lever 112 is rotated in a pivotal manner about the central shaft 111 in association with rotation of a cam 120 to be driven by a manual operation through a gear 121. When the swing end of the pressure lever 112 is pressed upward, the fixing belt 100 is spaced apart from the pressure roller 101, with the result that the heating nip N is released. With this, in a case where the recording material P is jammed in the middle of conveyance during the operation of the fixing apparatus 40, when a user operates a mechanism configured to release the heating nip N by spacing the fixing belt 100 apart from the pressure roller 101, the jammed recording material P stopped by being nipped between the fixing belt 100 and the pressure roller 101 can be easily removed.

As illustrated in FIG. 6, the heating member 102 includes a heating resistor 53*b* as a heat source, which is supplied with an electric power to generate heat. The heating member 102 constitutes a ceramic heater that rises in temperature through Joule heating by being energized through electrodes 53*d*. The heating resistor 53*b* and the electrodes 53*d* are formed on a ceramic substrate 53*a* and covered with a glass layer 53*c*. The ceramic substrate 53*a* is an aluminum nitride substrate excellent in thermal conductivity. The heating resistor 53*b* is formed by thick-film printing and baking of an Ag—Pd paste. The glass layer 53*c* is formed of a glass coating layer as a sliding member, which has a thickness of approximately from 50 μm to 60 μm and is provided integrally on the heating resistor 53*b*.

On the ceramic substrate 53*a* on a side opposite to a side on which the heating resistor 53*b* is provided, there is provided a thermistor 54 configured to monitor a temperature of the ceramic substrate 53*a*. The thermistor 54 is held in pressure contact with the ceramic substrate 53*a* at a predetermined pressure by a pressure spring (not shown) so as to detect even temperatures exceeding the heatproof temperature of an adhesive. The output of the thermistor 54 is fed back to a temperature control circuit 73. The temperature control circuit 73 maintains the temperature of the heating member 102 within a certain range by controlling a switching element 72 of an AC power source 71 based on the feedback from the thermistor 54.

As illustrated in FIG. 2, during the process in which the recording material P is nipped and conveyed by the heating nip N, the recording material P receives thermal energy from the heating member 102 through the fixing belt 100. The unfixed toner images (not shown) on the recording material P are heated to be fused, and then pressurized to be fixed onto the recording material P.

In order to reduce the heat capacity to improve a quick start, it is desired that a base, made of a heatproof resin such as polyimide and PEEK and having a total thickness of 100 μm or smaller, preferably, 60 μm or less and 20 μm or more, be employed as a base of the fixing belt 100. Further, it is desired that a sheet or a coating layer excellent in releasability be arranged on a surface of the base, which is in contact with the recording material P.

Here, a polyimide base having a thickness of 50 μm is used as a base of the fixing belt 100 so that the fixing belt 100 has an inner diameter of 30 mm. A PFA layer, which is a fluorine resin layer having a thickness of 10 μm, is provided on the base. Alternatively, the fixing belt 100 may be obtained by laminating a releasing layer on a conductive layer laminated on a base layer formed of a sheet-like material having a high heat resistance as typified by polyester, polyethylene terephthalate, and polyimideamide.

As for the pressure roller 101, it is desired that an elastic layer formed of sponge or made of silicone rubber be arranged on the outer peripheral surface of a columnar core made of a metal such as iron or aluminum, and the releasing layer be provided on a surface of the elastic layer so that releasability of the recording material P is enhanced. Here, a surface of a core made of a mild steel material is roughened through a blasting process, and then washed. Next, the core is inserted into a cylindrical mold. Then, liquid silicone rubber is injected into the mold, and subjected to heat curing. At this time, in order to provide a PFA resin tube layer as a releasing layer on a surface layer of the pressure roller 101, a tube material having an inner surface applied with an adhesive material has been inserted in advance in the mold. In this way, simultaneously with heat curing of the rubber, the tube material and the rubber elastic layer are bonded to each other. The pressure roller thus molded is subjected to a removal process and then subjected to secondary vulcanization so that a hardness of the pressure roller is adjusted to a required hardness. The secondary vulcanization is performed by heating those components with an oven for a certain time period. The pressure roller 101 thus manufactured has an outer diameter of 30 mm, and the pressure roller 101 includes a core having a diameter of approximately 22 mm, a rubber elastic layer having a thickness of 4 mm, and a tube material having a thickness of 50 μm.

In the embodiments below, a lubrication film is uniformly applied in advance over the entire surface of the fixing belt 100 as a component to be replaced for maintenance, or a width in the rotational direction, which substantially corresponds to a width of a slidably rubbing portion of the inner surface of the belt. With this, it is unnecessary to perform an operation of applying the lubrication film at the time of replacement for maintenance, and hence operations can be performed with higher efficiency. Further, in the embodiments below, the lubrication film is substantially uniformly applied over the inner surface of the fixing belt 100. Thus, unsteadiness in sliding of the fixing belt 100 after replacement can be reduced.

First Embodiment

Figure 7:
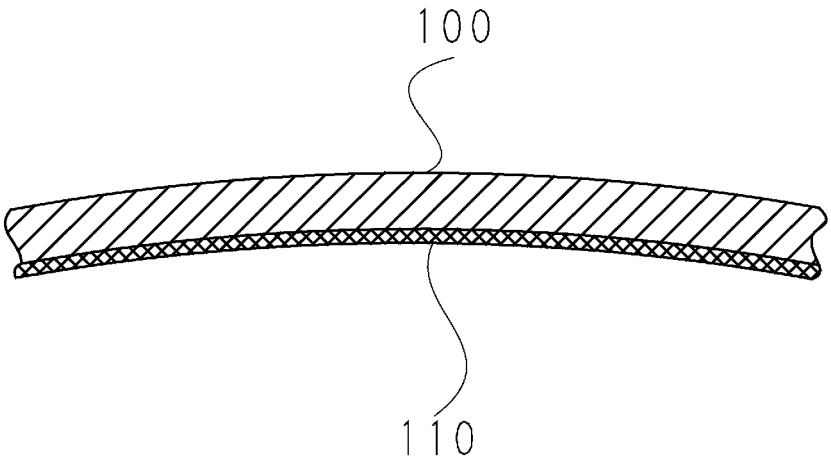
FIG. 7 is an explanatory view of an arrangement of a lubricating layer of a fixing belt.
Figure 8A:
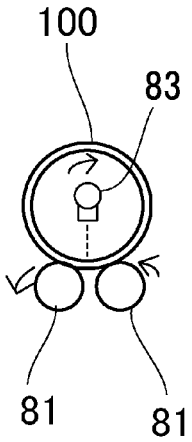
FIGS. 8A and 8B are explanatory views of a method of forming the lubricating layer.
Figure 8B:
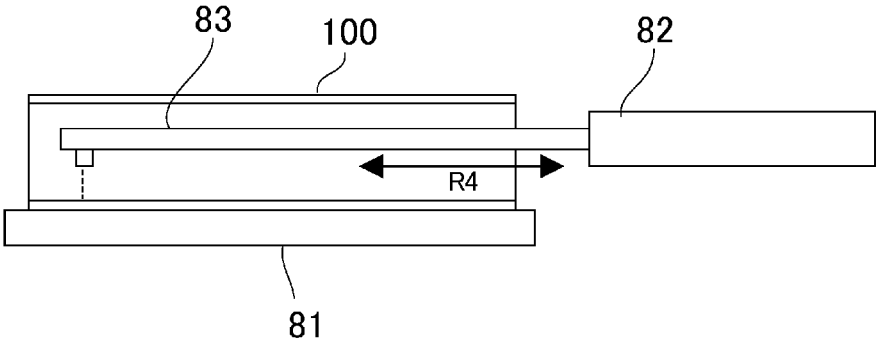

FIG. 7 is an explanatory view of an arrangement of a lubricating layer of the fixing belt. FIGS. 8A and 8B are explanatory views of a method of forming the lubricating layer.

As illustrated in FIG. 7 while referring to FIG. 2, the fixing belt 100 is formed into an endless shape, and has the inner surface which rubs, in a pressurized state, the non-rotatable pressure pad 103 in a sliding manner. The pressure pad 103 rubs the inner surface of the fixing belt 100 in a sliding manner through an abutment surface continuously provided in the width direction perpendicular to the rotational direction of the fixing belt 100.

The fixing belt 100 has the inner surface provided with the lubrication film 110 as an example of the lubricating layer in a state of a film which is applied in a liquid state and then unfluidized. The film state (coated state) of the lubrication film (lubrication coat) 110 is obtained as follows. A liquid material obtained by dispersing solid lubricant particles and oil into a volatile solvent is applied on the inner surface, and the volatile solvent is evaporated. After the solvent is evaporated, the lubrication film 110 does not have fluidity, and hence is in an adhesion state in which the lubrication film 110 can be wiped off. The solid lubricant particles and the oil are each a fluorinated material, and a thickness of the lubrication film 110 after evaporation of the solvent is 10 μm or more and 40 μm or less.

In the first embodiment, in order to reduce a sliding frictional force between the fixing belt 100 and the pressure pad 103 positioned at the heating nip N, the lubrication film 110 is formed on the entire inner surface of the fixing belt 100. After the fixing belt 100 is assembled to a mating component, the lubrication film 110, which is applied to the inner surface of the fixing belt 100 before the assembly, is partially scraped off by the sliding and rubbing mating component, and then held on the sliding surface of the pressure pad 103 (heating member 102) as a mating component. In this way, the lubricating layer interposed between the pressure pad 103 and the fixing belt 100 is formed.

The lubrication film 110 is in a liquid state before application, and is formed into a film by evaporating the solvent after application. Specifically, the lubrication film 110 is a lubrication film in which solid lubricant particles made of a fluorine resin such as polytetrafluoroethylene (PTFE) and a fluorine oil such as a polytetrafluoroethylene (PTFE) oil are dispersed in a fluorinated solvent such as a hexafluorodiethyl ether (HFE) solvent. After the solvent is evaporated from the lubrication film 110 applied as described above, the lubrication film 110 forms a coating of the solid lubricant particles and the oil at a portion at which the lubrication film 110 is applied. The properties of such a coating lubrication film are that it is in a liquid state at room temperature before the application, and it is a dry film (dry coat) after the application.

The drying level of the coating formed of the lubrication film 110 is changed by changing the amount ratio of the fluorinated solid lubricant particles and the fluorinated oil. In other words, the drying condition of the lubrication film 110 can be changed by changing the formulation ratio of the fluorinated solid lubricant particles and the fluorinated oil when necessary. Specifically, the mixing ratio of the amount of the oil is reduced in order to obtain a perfectly dry coating, and meanwhile, the mixing ratio of the amount of the oil is increased in order to obtain a slightly wet coating. In this way, the drying condition can be adjusted.

As a material for forming the lubrication film, there may be employed HANARL (trademark) produced by KANTO KASEI LTD. An application condition and drying performance of such a material may be adjusted by changing a ratio and a type of the solvent.

As illustrated in FIG. 7, the base layer of the fixing belt 100 is a resin layer formed into a film shape by drying a resin liquid applied to a columnar mold. The surface layer of the fixing belt 100 is a releasing layer or a removing layer obtained by applying a fluorine resin material by dipping (immersion) or spraying onto a base material that has been formed into a film shape in the columnar mold.

FIG. 8A illustrates the rotational direction of the fixing belt 100. FIG. 8B is a sectional view illustrating a reciprocating movement of a nozzle 83.

As illustrated in FIGS. 8A and 8B, after the fixing belt 100 is removed from the columnar mold, the coating lubrication film is applied to the inner surface of the fixing belt 100. The horizontally elongated nozzle 83 is moved at a constant speed in the directions indicated by the arrow R4 while dropping the lubrication liquid at a constant dispensing rate from a tip end of a dispenser 82 having the nozzle 83. In this way, the coating lubrication film can be supplied uniformly in a longitudinal direction. The fixing belt 100 is rotated at a constant speed by two belt support rollers 81.

A slide of the dispenser 82 is controlled in position by a ball screw and a motor, and in this state, a dispensing timing of a dispensing pump of the dispenser 82 is controlled in synchronization with the motor. An application amount is managed based on a shape of a dispensing port and an indicated value of a flow rate sensor for the coating lubrication film. With those components, the coating lubrication film can be uniformly applied to the entire region of an inner peripheral surface of the fixing belt 100.

When the coating lubrication film applied through the sliding of the dispenser is dried, the lubrication film 110 is formed as a coating on the inner surface of the fixing belt 100. In the first embodiment, the lubrication film 110 is thin, and hence does not flow around the fixing belt 100 to reach the front surface side thereof. Thus, the application range in the longitudinal direction of the fixing belt 100 corresponds to the entire region from one end portion to the other end portion of the fixing belt 100.

In the first embodiment, the dry film thickness was controlled to range from 20 μm to 30 μm after evaporation of the solvent at a ratio of the solvent of 80%. Through control of the thickness with an accuracy of 120 μm±40 μm at the time of application, a dry film thickness of 25 μm±8 μm was obtained. The designed life (1,500,000 A4-sized plain sheets) of the fixing belt 100 was not impaired as long as the dry film thickness of 5 μm or more is secured, and the lubrication film is not fluidized by the pressure of the pressure roller 101 or does not apparently adhere to the fingers of a person as long as the dry film thickness of 50 μm or less is secured.

The fixing belt 100 is replaced by inserting a new replacement fixing belt 100 substantially along a width direction thereof after the used fixing belt is pulled out substantially along the width direction thereof from the assembly integrally incorporating the pressure pad 103.

Note that, when conventional heat-resistant grease is applied to the surface of the heating member 102, the heat-resistant grease is completely scraped off or scraped together by a belt edge of the fixing belt 100 at the time of insertion of the fixing belt 100 into the assembly.

Thus, unevenness in distribution of heat-resistant grease may occur after assembly of the fixing belt 100. Even when internal components rub the fixing belt 100 in a circumferential direction at the time of insertion of the fixing belt 100, unevenness in distribution of heat-resistant grease may occur.

Further, as the conventional heat-resistant grease is in a semiliquid state, the conventional heat-resistant grease moves in a flowing manner during storage or use when being applied to the inner surface of the fixing belt 100 in advance. Thus, even when the conventional heat-resistant grease is uniformly applied using a machine before shipment, the uniform application distribution is disturbed during transportation. Further, the conventional heat-resistant grease may taint the inside of a packaging material for the fixing belt 100. Still further, the conventional heat-resistant grease may adhere to the hand during an operation, and transfer from the hand, with the result that fingerprints may adhere to surrounding parts.

In contrast, the lubrication film is formed as a coating through evaporation of the solvent immediately after application of the lubrication film itself. Thus, at the time of insertion of the fixing belt 100, the entire lubrication film is not moved even when the fixing belt 100 comes into contact with the components of the assembly, and hence application unevenness is not liable to occur. After the coating is formed, the lubrication film is not fluidized even when the fixing belt 100 is vertically held in a high-temperature environment, or scarcely transferred to the hand even when being touched with the hand. Further, there is no risk that the lubrication film flows during transportation of the fixing belt alone, and hence the packaging material is not tainted. In addition, during an operation, dirt or fingerprints do not adhere to surrounding parts through the hand.

The fixing belt 100 is applied in advance with a liquid for forming a lubrication film on the fixing belt 100 itself by a predetermined method and a predetermined application amount. Thus, unlike a case where the liquid for forming the lubrication film is applied at the time of maintenance in which the fixing belt is used, variation in application amount and unevenness of application do not occur. As a result, the lubrication film can be stably applied in a highly reproducible manner. Even after the liquid for forming a lubrication film is uniformly applied at a factory, the lubrication film does not move during transportation of the fixing belt alone. Thus, an initial uniform application condition is maintained from the time of application at the factory to the time of assembly for maintenance, and the application amount after assembly at the time of replacement for maintenance can be equalized and uniformized.

During transportation of the fixing belt 100 alone after the liquid for forming a lubrication film is applied and dried on the fixing belt 100, the lubrication film applied to the inner surface does not move or drip from the end portions. Thus, the fixing belt 100 can be normally stored as a maintenance replacement component and normally treated. The fixing belt 100 used in this case is applied in advance with the liquid for forming the lubrication film 110 on the fixing belt 100 itself by a predetermined method and a predetermined application amount. Thus, at the time of maintenance, variation in application amount and unevenness of application of the lubrication film do not occur. As a result, the lubrication film can be stably applied.

The lubrication film 110 is not fluidized even when being exposed to a high temperature, and does not move in the rotation axis direction of the fixing belt 100 even when being pressurized. Thus, the lubrication film does not flow around the outer surface of the fixing belt 100 to transfer to the recording material.

The lubrication film 110 is formed through evaporation of the solvent after being applied in a liquid state. Thus, a thickness of the lubrication film 110 is uniform and smaller than that of the applied liquid. As a result, the lubrication film 110 smaller in variation in lubrication performance from point to point on the fixing belt 100 can be formed.

As described above, the lubricating layer is formed in advance on the inner surface of the fixing belt 100, and hence it is unnecessary to form a lubricating layer during an operation on site. As a result, a replacement operation can be facilitated.

Second Embodiment

Figure 9:
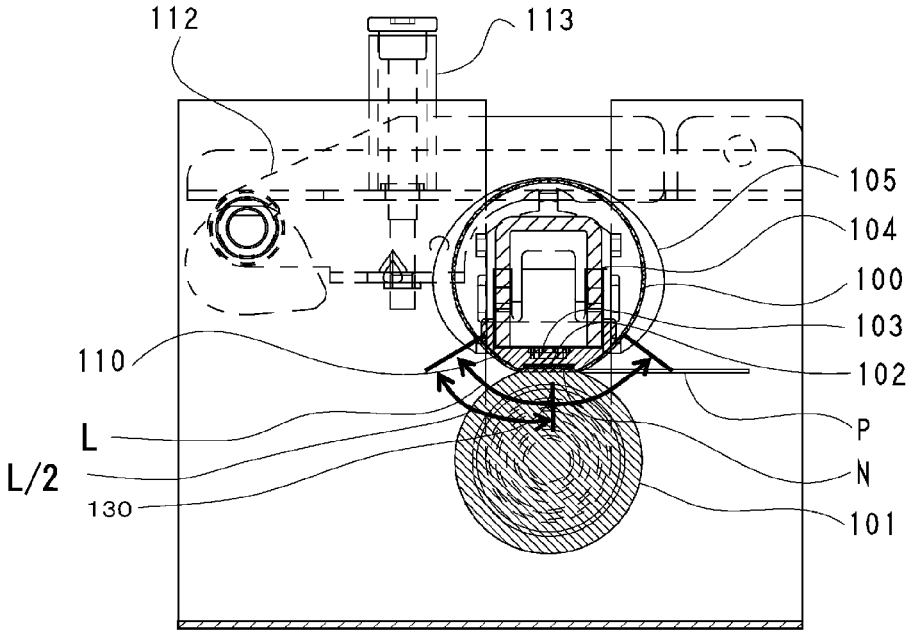
FIG. 9 is an explanatory view of a structure of a fixing apparatus according to a second embodiment of the present invention.
Figure 10:
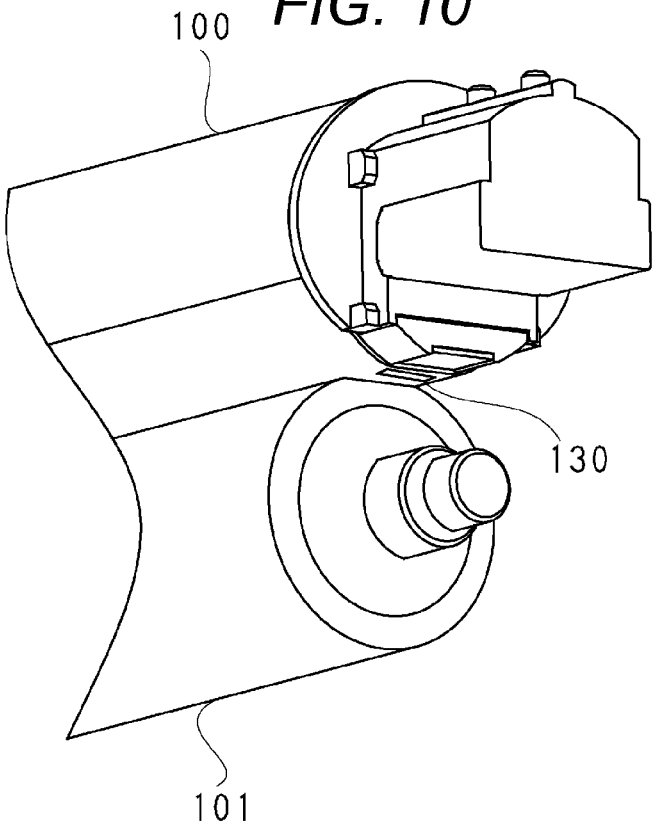
FIG. 10 is an explanatory view of a marking formed on an outer peripheral surface of the fixing belt.

FIG. 9 is an explanatory view of a structure of a fixing apparatus according to a second embodiment of the present invention. FIG. 10 is an explanatory view of a marking formed on the outer peripheral surface of the fixing belt. In the first embodiment, the lubrication film 110 is formed on the entire inner surface of the fixing belt 100. In contrast, in the second embodiment, the lubrication film 110 is formed on a part of the inner surface of the fixing belt 100. Other details of the structure of the fixing apparatus 40, the type of the coating lubrication film, the method of manufacturing the fixing belt 100, and the method of forming the lubrication film 110 are the same as those in the first embodiment. Thus, in FIG. 9, the same components as those in the first embodiment are denoted by the same reference symbols as those in FIG. 2, and are not redundantly described.

As illustrated in FIG. 9, in the second embodiment, the lubrication film 110 is arranged on only a part of the inner surface of the fixing belt 100 in the circumferential direction correspondingly to the abutment surface of the pressure pad 103. The fixing belt 100 is assembled by being moved in the rotation axis direction in a state in which the abutment surface of the pressure pad 103 and the lubrication film 110 on the fixing belt 100 are positioned in the circumferential direction. As an example of a mark used for positioning at the time of assembly of the fixing belt 100, there is formed a manufacturer's serial number 130 on a part of the outer surface of the fixing belt 100, which corresponds to the lubrication film 110.

As illustrated in FIG. 2, when the lubrication film 110 is formed on the entire inner surface of the fixing belt 100, the component (104) of the assembly to be inserted into the inner side of the fixing belt 100 may rub and peel off the lubrication film 110, or scrape together the lubrication film 110.

As a countermeasure, as illustrated in FIG. 9, in the second embodiment, the liquid for forming a lubrication film is applied only in a predetermined application range out of the component (104) which may come into contact with the fixing belt 100 at the time of mounting the fixing belt 100. Further, the fixing belt 100 is assembled in a state in which the application portion of the liquid for forming a lubrication film is conformed to an area of the heating nip N. In this way, the lubrication film is prevented from unnecessarily adhering to the component (104) which may come into contact with the fixing belt 100 at the time of mounting the fixing belt 100.

As illustrated in FIG. 10, a mark, specifically, the serial number 130 is provided at an end portion of the outer peripheral surface of the fixing belt 100 so that a manufacturing condition is managed for each fixing belt 100. Near the end portion of the surface of the PFA layer of the fixing belt 100, the serial number 130 represents several-digit alphanumeric characters along the rotational direction. In consideration of resistance against heating, the serial number 130 is engraved using a laser marker. However, the serial number 130 may be printed with a heatproof ink by using a general marking machine. No other referential marks (for example, mark for detecting, by a sensor, a reference position in the rotational direction) are not provided on the outer peripheral surface of the fixing belt 100.

Note that, in this embodiment, the lubrication film is formed after the mark is formed on the fixing belt, but the lubrication film and the mark may be formed in a reverse order.

As illustrated in FIG. 9, the lubrication film 110 for reducing the sliding frictional force at the heating nip N is applied to an application range of an application width length L in the rotational direction on the inner surface of the fixing belt 100. Specifically, the lubrication film 110 is applied to both sides with respect to a center of the numeric string of the serial number (130: FIG. 10) on the outer peripheral surface of the fixing belt 100, that is, a center of the application width. In other words, the lubrication film 110 is applied to the application range of the application width length L corresponding to a length of a belt contact region of the pressure pad 103 on the inner surface of the fixing belt 100. More specifically, the lubrication film 110 is applied in application ranges each corresponding to a length L/2 in the circumferential direction on both the sides with respect to the serial number (130: FIG. 10) as the center, in other words, in the application range corresponding to the length L in total.

In the second embodiment, the lubrication film 110 having the application width length L is dispersed over the entire inner peripheral surface of the fixing belt 100 after assembly of the fixing belt 100. Thus, in comparison with the lubrication film 110 in the first embodiment, the lubrication film 110 has higher fluidity after drying, and is larger in layer thickness. Thus, in consideration of runoff of the lubrication from the end portions, the lubrication film 110 was partially applied in the longitudinal direction of the fixing belt 100, specifically, applied only on a central part out of ranges each corresponding to 7 mm from the end portions of the fixing belt 100. Note that, a slidably rubbing surface of the belt guide (105: FIG. 3) with respect to the fixing belt is made of a fluorine resin, and hence it is unnecessary to form the lubrication film 110 thereon.

As illustrated in FIG. 10, when the fixing belt 100 is assembled into a fixing belt unit at the time of replacement of a fixing belt, the fixing belt 100 is positioned by aligning a substantially central portion of the serial number 130 and a substantially central portion of the pressure pad 103. Then, the fixing belt 100 is inserted in the rotation axis direction. In this way, the fixing belt 100 is assembled.

In the second embodiment, the lubrication film 110 is applied only to the range of the fixing belt 100 in which the lubrication film 110 comes into contact with the pressure pad 103. Specifically, the lubrication film 110 is applied only to the inner surface on a back side of the serial number 130 on the outer peripheral surface of the fixing belt 100. Thus, when the fixing belt 100 is assembled by positioning the serial number 130 and the pressure pad 103 to each other by sight, the lubrication film 110 comes into contact only with a contact portion of the pressure pad 103 with respect to the fixing belt 100, which is an adhesion target of the lubrication film 110. With this, at the time of assembly, the lubrication film 110 is kept out of contact with components such as the belt frame 104 arranged on the inner side of the fixing belt 100. Thus, the application condition of the lubrication film 110 on the fixing belt 100 is less liable to be deteriorated at the time of assembly, and hence operation of the image forming apparatus can be started after the assembly while maintaining the initial application condition at the time of application.

Note that, the coating formed after drying the lubrication film 110 is thicker than that in the first embodiment, but the coating is a thin film having a thickness one tenth or smaller than that of the conventional heat-resistant grease, and hence thermal conduction is scarcely hindered. As a result, unevenness of heating between the application range and the non-application range scarcely causes problems. Therefore, problems with image quality are less liable to occur even without execution of an idle rotation mode at the start of operation.

In the second embodiment, as well as the small thickness and the small absolute amount of the lubrication film 110, the lubrication film 110 is partially applied in the longitudinal direction while avoiding the end portions. Thus, movement, scattering, and liquid dripping of the lubrication film 110 do not occur during transportation of the fixing belt 100. Further, the lubrication film 110 is partially applied also in the circumferential direction, and hence does not adhere to the components on the inner side of the fixing belt at the time of replacement of the fixing belt 100. In addition, image defects do not occur even after component replacement for maintenance. When the lubrication film is formed in advance at a predetermined position on the replacement fixing belt 100, an operation at the time of replacement of the fixing belt can be facilitated.

According to the structure described above in the embodiment, in a manufacturing step for the belt, specifically, at a factory, a lubrication dry film in a uniform application condition is formed in advance on the inner surface of the fixing belt (conventionally, on the side of a mating member with respect to a component applied with a lubrication film) by using a machine. Thus, replacement can be performed with higher efficiency. The lubrication dry film is obtained through evaporation and drying of a solvent, and hence liquid dripping does not occur. Thus, without involving liquid dripping, the fixing belt can be transported to a site at which the fixing apparatus is replaced (place at which the image forming apparatus is installed).

The lubrication film described above in the embodiment includes a lubrication film which is formed at the time of manufacturing the fixing belt but is not applied at the time of assembly of the fixing belt.

Third Embodiment

As illustrated in FIG. 9, in the second embodiment, the lubrication film 110 is formed within a circumferential range of the fixing belt 100 corresponding to the pressure pad 103. In a third embodiment of the present invention, the lubrication film 110 is formed out of the circumferential range of the fixing belt 100 corresponding to the pressure pad 103, and after assembly, the lubrication film 110 is positioned with respect to the heating nip N by rotating the fixing belt 100 in the circumferential direction. The fixing apparatus 40, the fixing belt 100, and the lubrication film 110 are the same as those in the second embodiment, and at the time of insertion and positioning in the circumferential direction, the serial number (130: FIG. 10) as a mark is used as a referential mark.

When the fixing belt 100 is initially positioned with respect to the pressure pad 103 and then inserted in the rotation axis direction, the pressure pad 103 and the heating member 102 may rub and peel off the lubrication film 110, or scrape together the lubrication film 110 toward a deep side in the insertion direction, although the amount is not as much as that in the conventional thick heat-resistant grease. As a countermeasure, the application range of the lubrication film 110 is positioned to a circumferential position at which the fixing belt 100 does not interfere with components, and then the fixing belt 100 is moved in the rotation axis direction. After that, the lubrication film 110 is positioned with respect to the pressure pad 103 by manually rotating the fixing belt 100 in the circumferential direction.

Fourth Embodiment

In a fourth embodiment of the present invention, the inner surface of the fixing belt 100 is roughened through sand-blasting treatment (surface roughening treatment) prior to formation of the lubrication film 110. In this way, compatibility with the lubrication film 110 is enhanced, with the result that an amount of the lubrication film 110 scraped by components which rub the lubrication film 110 in a sliding manner at the time of assembly is reduced. The sand-blasting treatment produces an effect of suppressing movement of fluorinated solid lubricant resin particles in the lubrication film along the surface of the fixing belt 100. Further, by performing the sand-blasting treatment while masking the inner surface of the fixing belt 100, a region in which movement of the fluorinated solid lubricant resin particles is suppressed can be limited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-216977, filed Sep. 30, 2011, which is hereby incorporated by reference herein in its entirety.

What is claimed is:

1. A replacement fixing belt to be used in a fixing apparatus, the replacement fixing belt comprising:

an endless base layer provided as an inner surface layer of the replacement fixing belt;

a toner releasing layer provided as an outer surface layer of the replacement fixing belt; and a lubrication film formed on an inner surface of the endless base layer by applying to the inner surface a liquid in which a fluorinated oil and fluorinated solid lubricant particles are dispersed in a volatile solvent.

2. A replacement fixing belt according to claim 1, wherein the lubrication film comprises a dry film.

3. A replacement fixing belt according to claim 1, wherein a thickness of the lubrication film is 10 μm or more and 40 μm or less.

4. A replacement fixing belt according to claim 1, wherein the lubrication film is formed in a partial region of the endless base layer in a circumferential direction of the endless base layer, and wherein the replacement fixing belt further comprises a mark provided at a position on an outer surface of the replacement fixing belt correspondingly to the partial region.

5. A replacement fixing belt according to claim 1, wherein the inner surface of the endless base layer is subjected to surface roughening treatment, and wherein the lubrication film is formed after the surface roughening treatment.

6. A method of replacing a fixing belt to be used in a fixing apparatus, the method comprising:

forming a lubrication film by applying a liquid in which a fluorinated oil and fluorinated solid lubricant particles are dispersed in a volatile solvent to an inner surface of a replacement fixing belt including an endless base layer provided as an inner surface layer of the replacement fixing belt and a toner releasing layer provided as an outer surface layer of the replacement fixing belt;

pulling out a used fixing belt from the fixing apparatus substantially along a width direction of the used fixing belt; and inserting the replacement fixing belt into the fixing apparatus substantially along a width direction of the replacement fixing belt.

7. A method of replacing a fixing belt to be used in a fixing apparatus, the method comprising:

forming a lubrication film by applying a liquid in which a fluorinated oil and fluorinated solid lubricant particles are dispersed in a volatile solvent to a part in a circumferential direction of an inner surface of a replacement fixing belt including an endless base layer provided as an inner surface layer of the replacement fixing belt and a toner releasing layer provided as an outer surface layer of the replacement fixing belt;

forming a mark at a position on an outer surface of the replacement fixing belt correspondingly to the part on which the lubrication film is formed;

pulling out a used fixing belt from the fixing apparatus substantially along a width direction of the used fixing belt; and inserting the replacement fixing belt into the fixing apparatus substantially along a width direction of the replacement fixing belt in a manner that the mark is aligned with a predetermined position in the fixing apparatus.

8. A method according to claim 7, wherein the predetermined position corresponds to a position in which a pressure pad of the fixing apparatus is provided.

9. A method of replacing a fixing belt to be used in a fixing apparatus, the method comprising:

forming a lubrication dry film on an inner surface of a replacement fixing belt including an endless base layer provided as an inner surface layer of the replacement fixing belt and a toner releasing layer provided as an outer surface layer of the replacement fixing belt;

pulling out a used fixing belt from the fixing apparatus substantially along a width direction of the used fixing belt; and inserting the replacement fixing belt into the fixing apparatus substantially along a width direction of the replacement fixing belt.

10. A method of replacing a fixing belt to be used in a fixing apparatus, the method comprising:

forming a lubrication dry film on a part in a circumferential direction of an inner surface of a replacement fixing belt including an endless base layer provided as an inner surface layer of the replacement fixing belt and a toner releasing layer provided as an outer surface layer of the replacement fixing belt;

forming a mark at a position on an outer surface of the replacement fixing belt correspondingly to the part on which the lubrication dry film is formed;

pulling out a used fixing belt from the fixing apparatus substantially along a width direction of the used fixing belt; and inserting the replacement fixing belt into the fixing apparatus substantially along a width direction of the replacement fixing belt in a manner that the mark is aligned with a predetermined position in the fixing apparatus.

11. A method according to claim 10, wherein the predetermined position corresponds to a position in which a pressure pad of the fixing apparatus is provided.

12. A method of replacing a fixing belt to be used in a fixing apparatus, the method comprising:

providing a replacement fixing belt including an endless base layer provided as an inner surface layer of the replacement fixing belt and a toner releasing layer provided as an outer surface layer of the replacement fixing belt, on an inner surface of the replacement fixing belt a lubrication film being formed by applying a liquid in which a fluorinated oil and fluorinated solid lubricant particles are dispersed in a volatile solvent;

pulling out a used fixing belt from the fixing apparatus substantially along a width direction of the used fixing belt; and inserting the replacement fixing belt into the fixing apparatus substantially along a width direction of the replacement fixing belt.

13. A method of replacing a fixing belt to be used in a fixing apparatus, the method comprising:

providing a replacement fixing belt including an endless base layer provided as an inner surface layer of the replacement fixing belt and a toner releasing layer provided as an outer surface layer of the replacement fixing belt, on a part in a circumferential direction of an inner surface of the replacement fixing belt a lubrication film being formed by applying a liquid in which a fluorinated oil and fluorinated solid lubricant particles are dispersed in a volatile solvent, on an outer surface of the replacement fixing belt a mark being formed at a position corresponding to the part on which the lubrication film is formed;

pulling out a used fixing belt from the fixing apparatus substantially along a width direction of the used fixing belt; and inserting the replacement fixing belt into the fixing apparatus substantially along a width direction of the replacement fixing belt in a manner that the mark is aligned with a predetermined position in the fixing apparatus.

14. A method according to claim 13, wherein the predetermined position corresponds to a position in which a pressure pad of the fixing apparatus is provided.

15. A method of replacing a fixing belt to be used in a fixing apparatus, the method comprising:

providing a replacement fixing belt including an endless base layer provided as an inner surface layer of the replacement fixing belt and a toner releasing layer provided as an outer surface layer of the replacement fixing belt, on an inner surface of the replacement fixing belt a lubrication dry film being formed;

pulling out a used fixing belt from the fixing apparatus substantially along a width direction of the used fixing belt; and inserting the replacement fixing belt into the fixing apparatus substantially along a width direction of the replacement fixing belt.

16. A method of replacing a fixing belt to be used in a fixing apparatus, the method comprising:

providing a replacement fixing belt including an endless base layer provided as an inner surface layer of the replacement fixing belt and a toner releasing layer provided as an outer surface layer of the replacement fixing belt, on a part in a circumferential direction of an inner surface of the replacement fixing belt a lubrication dry film being formed, on an outer surface of the replacement fixing belt a mark being formed at a position corresponding to the part on which the lubrication dry film is formed;

pulling out a used fixing belt from the fixing apparatus substantially along a width direction of the used fixing belt; and inserting the replacement fixing belt into the fixing apparatus substantially along a width direction of the replacement fixing belt in a manner that the mark is aligned with a predetermined position in the fixing apparatus.

17. A method according to claim 16, wherein the predetermined position corresponds to a position in which a pressure pad of the fixing apparatus is provided.

* * * * *